United States Patent [19]

French et al.

[11] 4,447,099

[45] May 8, 1984

[54] LOCKER CONSTRUCTION

[75] Inventors: Robert J. French, Wadsworth; Elmer F. Dorony, Parma, both of Ohio

[73] Assignee: Interior Steel Equipment Co., Cleveland, Ohio

[21] Appl. No.: 291,441

[22] Filed: Aug. 10, 1981

[51] Int. Cl.³ ..... A47B 43/00

[52] U.S. Cl. ..... 312/257 R; 312/257 SK; 312/263; 16/382

[58] Field of Search ..... 312/257 R, 257 SK, 257 SM, 312/257 A, 263; 16/382

[56] References Cited

U.S. PATENT DOCUMENTS

| | | | |
|---|---|---|---|
| 212,149 | 2/1879 | Morgeneier | 16/382 |
| 1,973,579 | 9/1934 | Ryan et al. | 16/382 |
| 2,058,263 | 10/1936 | Rosendale | 312/257 R |
| 2,651,559 | 2/1953 | O'Connor | 312/257 R |
| 2,727,800 | 12/1955 | Snider | 312/263 |
| 2,846,080 | 8/1958 | Freeman | 312/257 R |
| 3,075,818 | 1/1963 | Fay | 312/257 R |
| 3,360,321 | 12/1967 | Novales | 312/257 R |
| 3,404,931 | 10/1968 | Fall et al. | 312/257 R |
| 3,819,246 | 6/1974 | List | 312/257 SK |
| 4,289,363 | 9/1981 | Andersson et al. | 312/257 R |

FOREIGN PATENT DOCUMENTS

| | | | |
|---|---|---|---|
| 2325057 | 12/1974 | Fed. Rep. of Germany | 16/382 |

*Primary Examiner*—Victor N. Sakran
*Attorney, Agent, or Firm*—Yount & Tarolli

[57] ABSTRACT

A light weight locker construction is disclosed for use in a bedroom or like area of a home and which simulates lockers used in locker rooms of stadiums or the like in connection with professional sports. The locker body is adapted to be assembled from prefabricated light gauge sheet metal panels and frame components, and locker doors are structured to provide a desired similarity in appearance with respect to professional lockers while promoting a light weight, economical construction necessary for acceptance of the locker for home use. Additionally, a unique hinge assembly is provided for certain of the door constructions.

25 Claims, 10 Drawing Figures

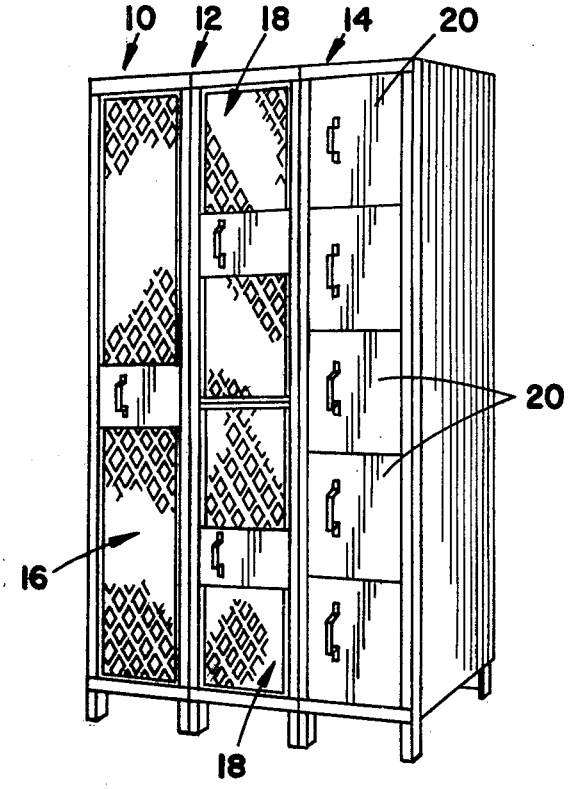
FIG. 1
FIG. 2
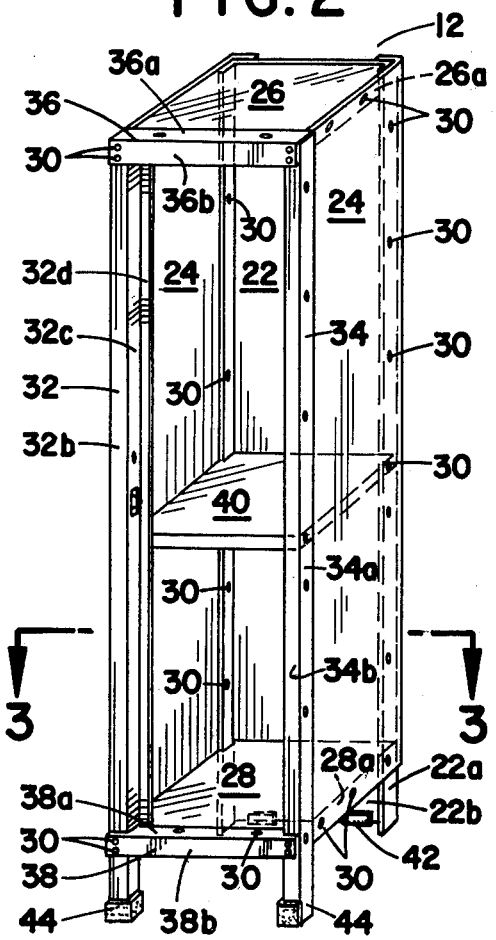
FIG. 4
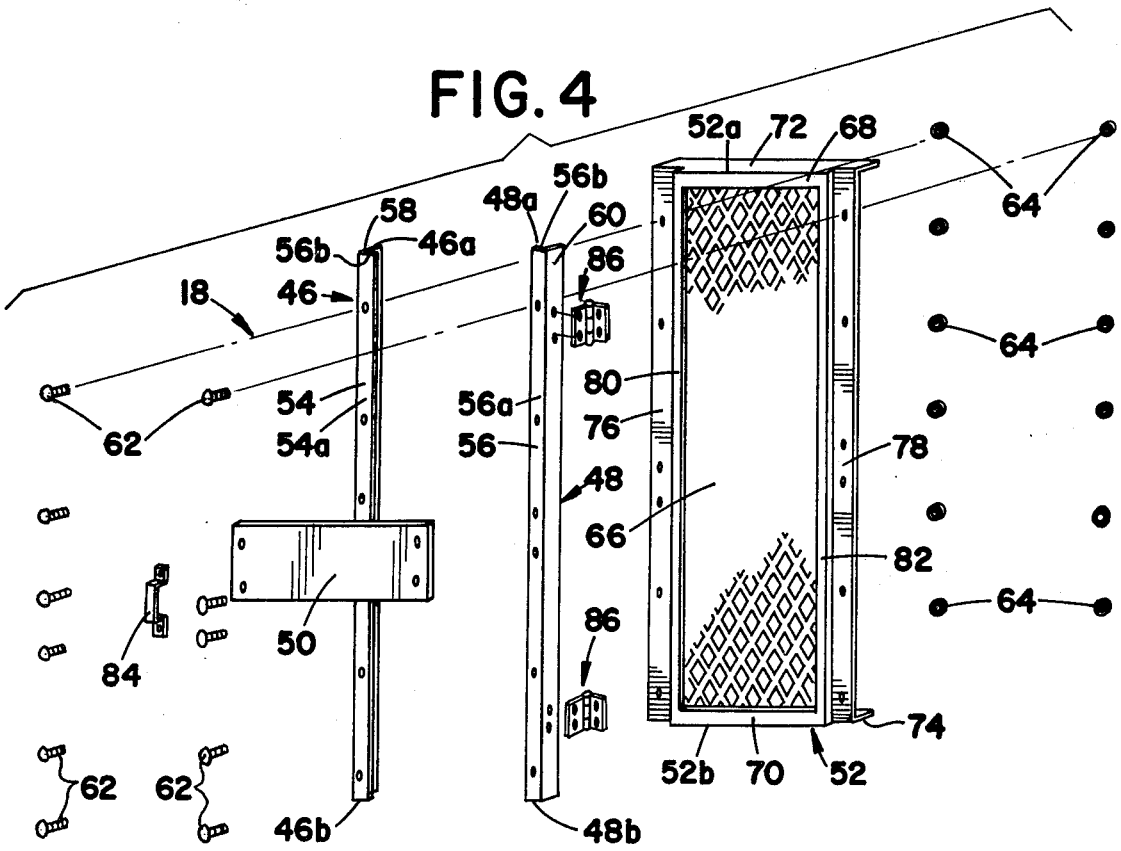

FIG. 3
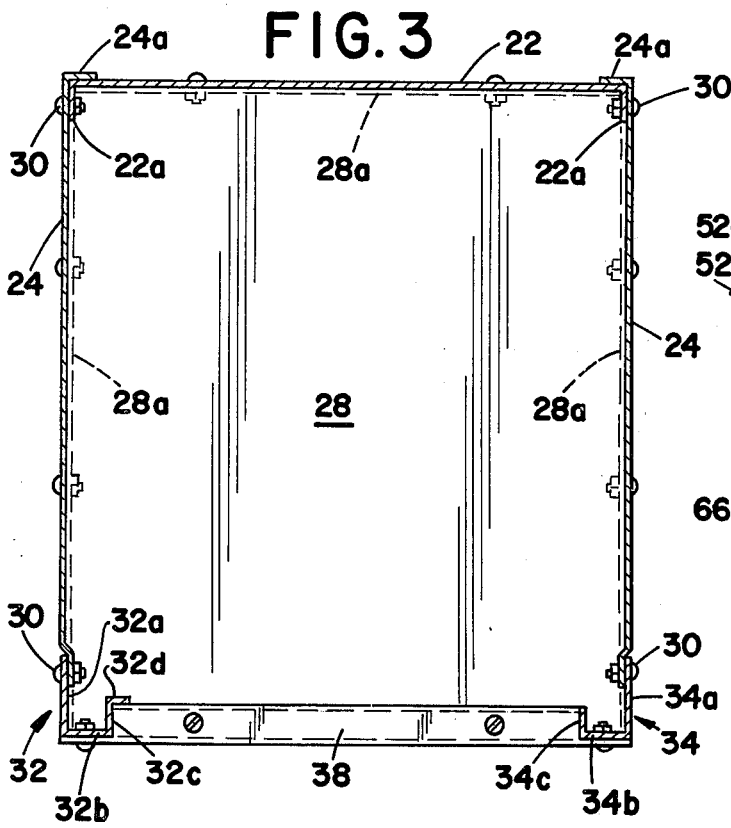
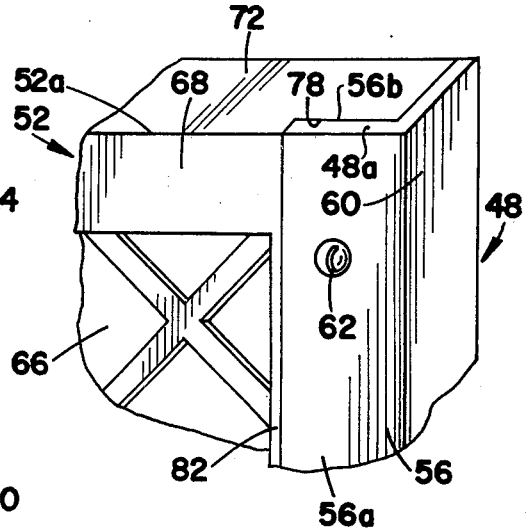
FIG. 5
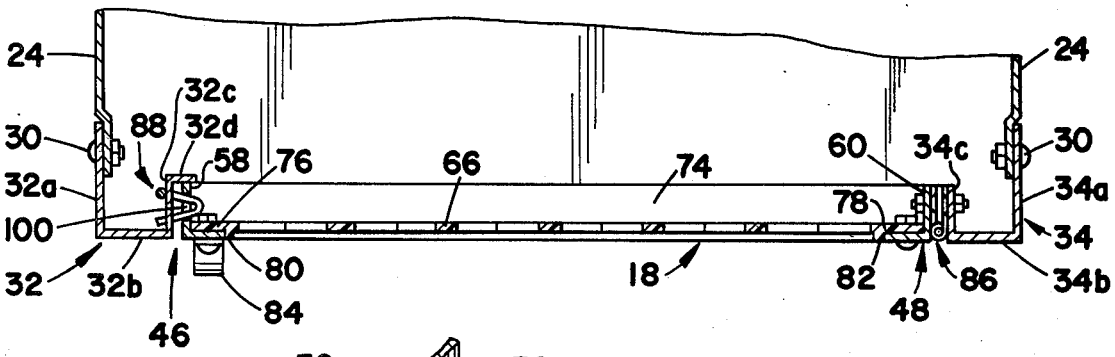
FIG. 6
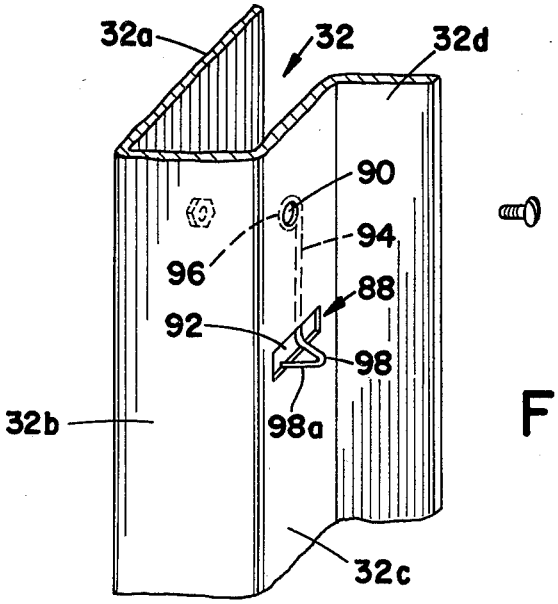
FIG. 7

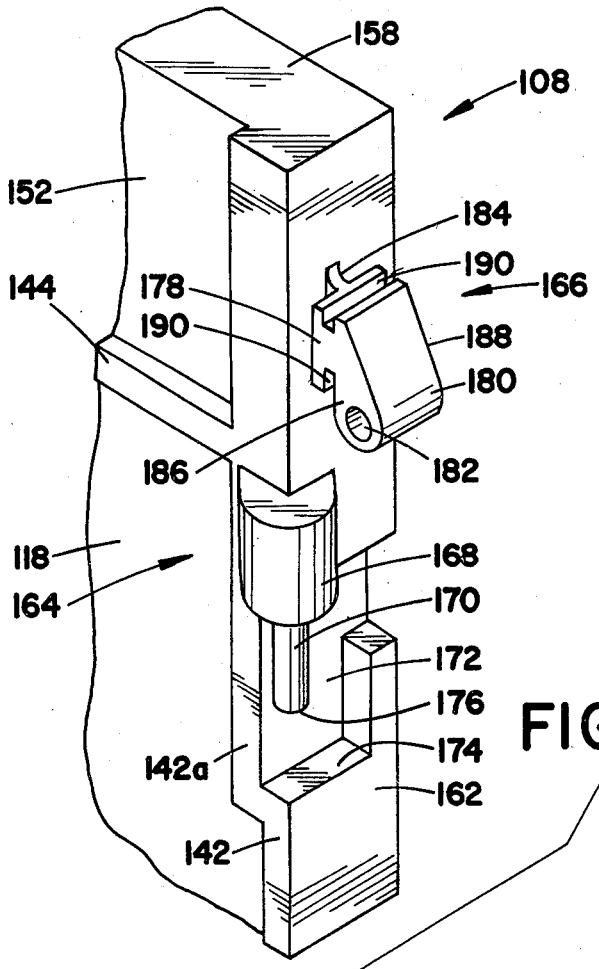
FIG. 9
FIG. 10
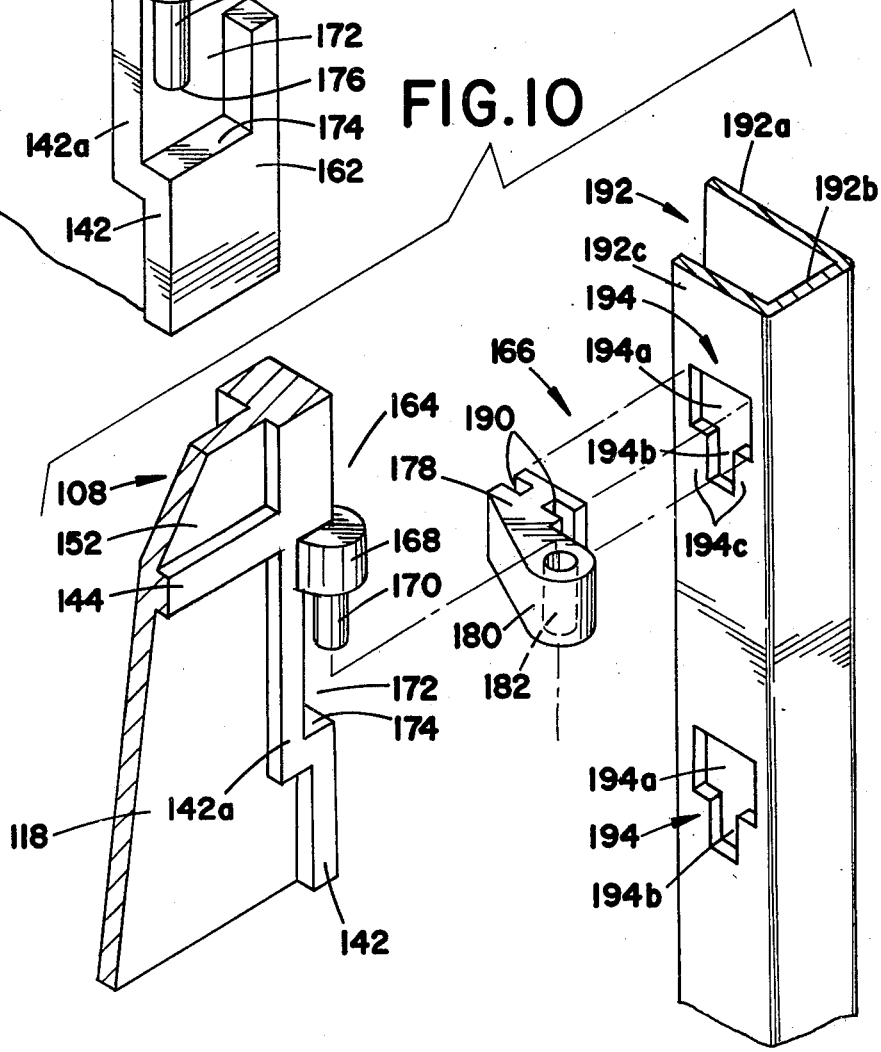

LOCKER CONSTRUCTION

BACKGROUND OF THE INVENTION

The present invention relates to the art of locker constructions and, more particularly, to structural features enabling the assembly of a light weight economical locker for use in a home and which simulates lockers used by professional athletes.

It is of course well known that professional athletes such as baseball, basketball and football players have personal lockers in the locker rooms of stadiums and the like in which their personal equipment is stored. Such lockers are constructed of heavy gauge metal frame members which are welded together, and sheet metal wall and shelf panels which are either welded, riveted or bolted to the frame members to provide the necessary structural integrity for the intended use and expected abuse of the locker during use. The lockers are generally constructed in individual units provided with different shelving and door arrangements enabling a number of different units to be selectively installed side-by-side to meet the space and other requirements of the individual athlete and/or the sport with which such athlete is associated. Often, the door or doors associated with such locker units are constructed of heavy gauge angle iron framing extending completely about the periphery thereof and having an open mesh panel welded thereto and defined, for example, by heavy gauge expanded metal. Further, the doors are adapted to be held closed and locked by heavy and complex latching and locking assemblies. Such locker units are of course constructed with the expectancy that they will be subjected to hard use over long periods of time, as well as occasional abuse, and accordingly are of a construction which, from the standpoint of weight, cost and handling, precludes their marketability for use in an environment outside the sports arena and such as in a home.

It is well known too that young people, especially preteen and teenagers, identify with professional athletes and athletic teams, and that such youth represents furture athletes as well as supporters of athletic teams. It is also well known that storage space in homes is often at a premium, especially in children's bedrooms, whereby it becomes necessary to supplement available storage space. With the latter in mind, together with developing and/or promoting youths' interest in athletics, it becomes desirable to provide a locker construction simulating that used by professional athletes and athletic teams and which is light in weight and economical for home use while providing sufficient structural integrity for such use. While the term locker is used herein in connection with the description of the invention it is to be understood that the term is not intended to imply lockability as is generally associated with use of the term.

SUMMARY OF THE INVENTION

In accordance with the present invention, a locker unit simulating those used by professional athletes is provided which is made practical for home use by features providing lightness in weight, ease in handling and economical production while at the same time providing sufficient structural integrity for its intended use. Lightness in weight is achieved in part by reducing the gauge of the sheet metal from which the body portion of the locker is constructed, and ease in handling is achieved in part through the reduced weight. Economy of production is also achieved through the use of lighter gauge sheet metal, and both the economy of production and handling are enhanced by providing for the component parts of the locker to be assembled such as through the use of nuts and bolts. This of course facilitates handling and storage considerations prior to assembly of the locker unit and reduces the cost of production by eliminating the time and cost of welding the component parts to one another. Further, such assembly permits the use of prefinished materials not usable where welding is required.

Further in accordance with the present invention, the attributes of lightness in weight and economy of production and handling are further promoted through the provision of unique door constructions and hinge assemblies for mounting thereof on the body portion of the locker, and which doors advantageously simulate the appearance of doors provided in connection with professional sport lockers including doors having an open mesh panel bounded by a peripheral frame. In accordance with one aspect of the present invention, a door having the latter characteristics is provided by an assembly comprising a generally H-shaped frame defined by light gauge metal members, and an open mesh panel defined by light weight non-metallic material attached to the metal frame such as by nut and bolt assemblies and having portions cooperable with the metal frame components to provide the appearance of a peripherally continuous frame bounding the open mesh panel. In accordance with another embodiment, locker doors including doors having an open mesh panel appearance are of one-piece molded plastic construction enabling the use of unique molded plastic hinge assemblies for mounting the doors on the body portion of the locker. The latter door construction and hinge feature further promotes lightness in weight and economy of production while enabling achieving the desired appearance for the doors simulating that used in connection with professional sports lockers. Additionally, the use of plastic in connection with or for the door components advantageously promotes safety in use of the locker by eliminating sharp metal edges and enables the molding of a desired logo or the like into the door.

In accordance with another aspect of the invention, the body portion of the locker unit is supported relative to a floor or the like by means of a pair of legs at the front of the body portion and by the back wall of the body portion which extends downwardly to the floor. This feature promotes economy by eliminating the forming of separate back legs for the body portion, and facilitates assembly of the locker unit by eliminating the mounting of such back legs.

It is accordingly an outstanding object of the present invention to provide a light weight, economical locker adapted to be assembled from preformed component parts for use in a home or the like and simulating lockers used by professional athletes.

Another object is the provision of a locker of the foregoing character having unique door constructions promoting economy, lightness in weight and a desired decorative appearance while affording sufficient structural integrity in use.

A further object is the provision of a locker of the foregoing character having a body portion assembled from preformed sheet metal component parts and a door assembly comprising an open mesh non-metallic panel mounted on a frame assembled from metal frame members which are not peripherally continuous about the panel and wherein the latter is cooperable with the frame components to simulate a frame peripherally bounding the panel.

Still a further object is the provision of a locker of the foregoing character having a body portion assembled from preformed sheet metal component parts and a door or doors of onepiece plastic construction pivotally mounted on the body portion by a unique molded plastic hinge assembly.

BRIEF DESCRIPTION OF THE DRAWINGS

The foregoing objects, and others, will in part be obvious and in part pointed out more fuly hereinafter in conjunction with the written description of preferred embodiments of the invention illustrated in the accompanying drawings in which:

FIG. 1 is a perspective view of three adjacent locker units, each including a body portion constructed according to the present invention and a door or doors constructed according to the present invention;

FIG. 2 is a perspective view of a body portion of a locker unit according to the invention;

FIG. 3 is a cross-sectional plan view of the body portion shown in FIG. 2 as seen along line 3—3 in FIG. 2;

FIG. 4 is an exploded perspective view of one embodiment of a locker door according to the present invention;

FIG. 5 is a detailed perspective view of a portion of the door assembly in FIG. 4 showing the component parts in assembled relationship;

FIG. 6 is an enlarged cross-sectional plane view through the front of the body portion of a locker and showing the door assembly in FIG. 4 mounted thereon;

FIG. 7 is a detailed perspective view of a latch assembly for the locker doors;

FIG. 9 is a detail perspective view showing the hinge components of the door in FIG. 8; and, FIG. 10 is an exploded perspective view of a portion of a locker door frame and the hinge components, and illustrating the manner in which the door in FIG. 8 is mounted on the body portion of a locker.

DESCRIPTION OF A PREFERRED EMBODIMENT

Figure 8:
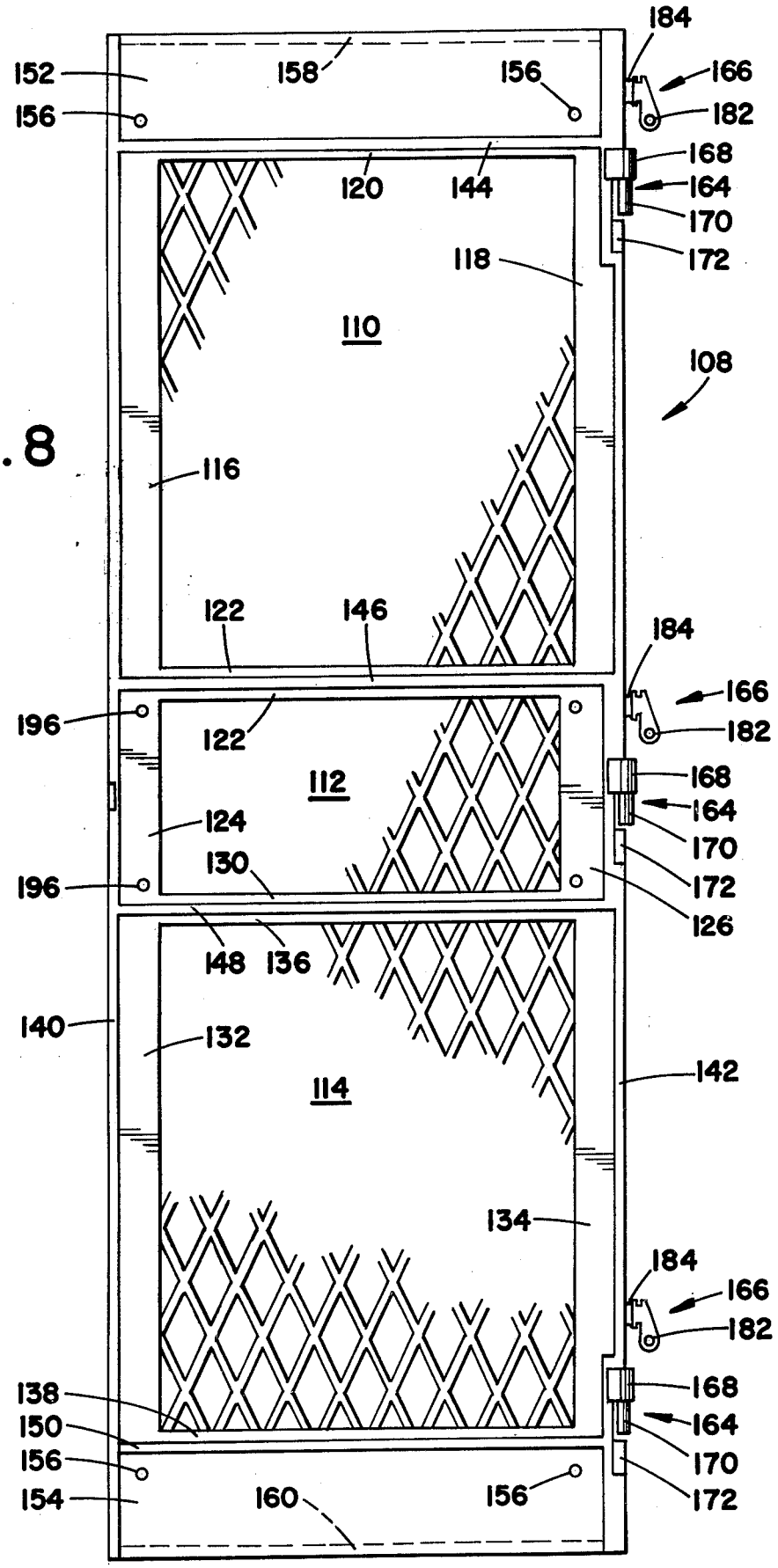
FIG. 8 is a front elevation view of another locker door in accordance with the present invention and showing hinge components therefor.

Referring now in greater detail to the drawings wherein the showings are for the purpose of illustrating preferred embodiments of the invention only and not for the purpose of limiting the invention, FIG. 1 illustrates three upright locker units 10, 12, and 14 disposed in laterally side-by-side relationship and the body portion of each of which locker units, as will become apparent hereinafter, is basically of the same construction. More particularly in this respect, each locker unit includes a body portion which is self-supporting relative to a floor or the like and which has an open front adapted to be provided with a corresponding door or doors. Accordingly, it will be appreciated that the locker units are adapted to be used individually as well as in a grouping such as that shown in FIG. 1. As will be seen in FIG. 1, locker unit 10 includes a full length door assembly 16, locker unit 12 includes a pair of vertically adjacent door assemblies 18, and locker unit 14 includes a plurality of vertically adjacent individual doors 20, which doors are constructed as described in detail hereinafter.

As mentioned hereinabove, each of the locker units 10, 12 and 14 has a body portion of the same basic construction, whereby it will be appreciated that the following description of the body portion for locker unit 12 is applicable to the constructions of the body portions of locker units 10 and 14. With this in mind, it will be seen from FIGS. 2 and 3 that the body portion of locker unit 12 is comprised of a back wall panel 22, laterally spaced apart side wall panels 24 extending forwardly from the back wall panel, and top and bottom wall panels 26 and 28, respectively, extending laterally between side wall panels 24 and forwardly from back wall panel 22. Panels 22, 24, 26 and 28 are of light gauge sheet metal, such as twenty-four or twenty-six gauge steel for example, and are preformed to enable assembly thereof through the use of nut and bolt assemblies and to provide structural integrity along the areas of juncture therebetween. More particularly in this respect, as will be appreciated from FIG. 3, back wall panel 22 is provided along its laterally opposite edges with forwardly extending flanges **22*a* which engage inside the rear edges of side wall panels 24 as defined by laterally inwardly extending flanges 24*a* extending along the lengths thereof. The back wall panel and side wall panels are interconnected by a plurality of nut and bolt assemblies 30 extending through side wall panels 24 and flanges 22*a*, and the overlapped flange arrangement promotes structural integrity along the vertically extending rear corners of the body portion. Top wall panel 26 and bottom wall panel 28 are identical and are provided with downwardly extending flanges 26*a* and 28*a* along the rear edges thereof and along the laterally opposite side edges thereof, and these wall panels are secured to back wall panel 22 and side wall panels 24 by means of nut and bolt assemblies 30. While the latter are only visible in FIG. 2 in connection with the top and bottom edges of one of the side wall panels 24, it will be appreciated from FIG. 3 that assemblies 30 extend through corresponding locations in the other side wall panel and the downwardly extending flanges in panels 26 and 28 and through back wall panel 22 and the downwardly extending flanges along the back edges of panels 26 and 28**.

The forwardly extending side wall panels 24, top wall panel 26 and bottom wall panel 28 provide the body portion of the locker unit with an open front which is bounded by vertically extending frame members 32 and 34 and top and bottom cross frame members 36 and 38, respectively, all of which frame members are of light gauge sheet metal construction, such as eighteen gauge steel for example. As will be seen in FIGS. 2 and 3, frame member 32 is generally channel-shaped in cross-section and includes a laterally outer and rearwardly extending flange **32*a*, a planar web portion 32*b* extending laterally inwardly of the open front of the body portion, and a laterally inner and rearwardly extending flange 32*c* which terminates in a laterally inwardly extending door strike flange 32*d* for the purpose set forth hereinafter. Similarly, frame member 34 is generally channel-shaped in cross-section and includes a laterally outer and rearwardly extending flange 34*a*, a laterally inwardly extending planar web portion 34*b*, and a laterally inner and rearwardly extending flange 34*c* which provides for hingedly mounting a door on the body portion as described hereinafter. The front edges of side wall panels 24** overlie the inner sides of the corresponding one of the flanges 32*a* and 34*a*, and the side wall panels and frame members are interconnected by nut and bolt assemblies 30 extending through the side wall panels and flanges. Top frame member 36 and bottom frame member 38 preferably are channel-shaped in cross-section and include upper and rearwardly extending flange portions 36*a* and 38*a*, respectively, which overlie the front edge of the corresponding one of the top and bottom wall panels 26 and 28 and are fastened thereto by means of corresponding nut and bolt assemblies 30. Further, frame members 36 and 38 include web portions 36*b* and 38*b*, respectively, having laterally opposite ends overlying web portions 32*b* and 34*b* of frame members 32 and 34 and fastened thereto by means of nut and bolt assemblies 30.

It will be appreciated from the foregoing description that the component parts of the body portion of the locker unit are adapted to be preformed and packaged in unassembled relationship to facilitate the storage and handling thereof. If desired, the body portion may be provided with one or more shelves between the top and bottom wall panels thereof such as shelf 40 illustrated in FIG. 2. Such a shelf would be preformed from light gauge sheet metal to have downwardly extending flanges 40*a* about the periphery thereof. Such flanges facilitate mounting of the shelf in the body portion such as by means of nut and bolt assemblies 30 extending through forwardly extending flanges 22*a* of the back wall panel and corresponding portions of side wall panels 24, and nut and bolt assemblies extending through frame members 32 and 34 and corresponding portions of side wall panels 24. Furthermore, it will be appreciated that a shelf corresponding to shelf 40 can be provided in the body portion of the locker unit close to the top thereof as opposed to the middle, such as in the locker unit 10 in FIG. 1 having a full length door. Likewise, a plurality of such shelves can be provided in the body portion of a locker such as locker unit 14 in FIG. 1 to provide a shelf corresponding to each locker door 20. It will be further appreciated that the interior of the body portion can be provided with appropriate hardware such as hooks or the like for hanging articles of clothing or the like, in which case a shelf or shelves might not be necessary or desired and accordingly would not be used.

As will be further seen from FIG. 2, frame members 32 and 34 extend downwardly below bottom wall panel 28 to provide support legs at the front of the locker unit, and back wall panel 22 includes a lower portion 22*b* extending downwardly below the bottom wall panel to provide a rear support for the locker unit. This advantageously avoids having to provide separate leg components at the back of the locker unit and which would be attached to the back and/or side wall panels. Back wall flanges 22*a* provide sufficient rigidity in connection with supporting the rear corners of the body portion. Preferably, the bottom edge of the back wall panel is provided with a plurality of plastic feet 42 frictionally attached thereto at locations along the length thereof and which serve the dual purpose of rigidifying the lower portion 22*b* against flexing and protecting the underlying support surface against scratching or cutting by direct engagement of the panel edge therewith. Preferably, for the latter purpose, the lower ends of frame members 32 and 34 are likewise provided with plastic feet 44.

A door assembly 18 for locker unit 12 and the mounting thereof on the body portion of the locker unit described hereinabove is shown in FIGS. 4–6 of the drawing. With reference first to FIG. 4, the door assembly is comprised of a pair of laterally spaced apart, upright metal door frame members 46 and 48, a sheet metal cross frame member 50, and a non-metallic open mesh door panel 52. Frame members 46, 48 and 50 are of light gauge sheet metal such as sixteen gauge steel, for example. It will be appreciated from FIG. 1 of the drawing that door 16, when assembled, is received in the open front of the body portion of the locker unit and that door frame members 46 and 48 extend upwardly along a corresponding side edge of the opening as defined by locker body frame members 32 and 34 in the embodiment described hereinabove. Door frame members 46 and 48 have corresponding top ends 46*a* and 48*a* and corresponding bottom ends 46*b* and 48*b*, and have first leg portions 54 and 56, respectively, which are coplanar and lie in the plane of the open front of the body portion of the locker. Leg portions 54 and 56 have corresponding outer sides 54*a* and 56*a* with respect to the open front of the body portion and corresponding inner sides 54*b* and 56*b*. Further, frame members 46 and 48 have second leg portions 58 and 60, respectively, each coextensive with the corresponding first leg portion along the laterally outer edge thereof and extending inwardly of the open front of the body portion of the locker unit. Frame members 46 and 48 are adapted to be interconnected in laterally spaced apart relationship by cross frame plate 50 which engages against the outer sides of first leg portions 54 and 56 and is adapted to be fastened thereto, as will become apparent hereinafter, by means of corresponding ones of the threaded bolts 62 and nuts 64 shown in FIG. 4.

Non-metallic open mesh door panel 52 is preferably produced from plastic, such as by injection molding, and includes an open mesh central panel portion 66 which preferably simulates planar expanded metal. Door panel 52 has top and bottom ends 52*a* and 52*b*, respectively, and is coextensive in the direction between these latter ends with door frame members 46 and 48. Door panel 52 includes laterally extending first strip portions 68 and 70 respectively along the top and bottom ends of central panel portion 66 and which first strip portions are coplanar and have a vertical width corresponding to the horizontal width of leg portions 54 and 56 of door frame members 46 and 48. The door panel further includes second strip portions 72 and 74 extending inwardly from the top and bottom edges of first strip portions 68 and 70, respectively, and having a width in the inward direction corresponding to the width of leg portions 58 and 60 of door frame members 46 and 48. Further, second strip portions 72 and 74 have a length in the lateral direction corresponding to the distance between the inner sides of leg portions 58 and 60 of door frame members 46 and 48 when the frame members and door panel are assembled. Door panel 52 further includes mounting strip portions 76 and 78 along the laterally opposite sides of central panel portion 66 and between top and bottom ends 52*a* and 52*b* of the door panel, and each of the mounting strip portions is recessed inwardly with respect to the plane of first strip portions 68 and 70 a distance equal to the thickness of leg portions 54 and 58 of door frame members 46 and 48. This advantageously provides for covering the raw edges of leg portions 54 and 56 of the door frame members. Preferably, for purposes of rigidity, central panel portion 66 is bounded along its opposite sides by narrow strip portions 80 and 82 which are coplanar with strip portions 68 and 70, and central panel portion 66 is recessed relative to strip portions 68, 70, 80 and 82 so as to be coplanar with mounting portions 76 and 78.

The door frame and panel components are assembled by positioning mounting strip portions 76 and 78 behind frame components 46 and 48 and respectively against the inner sides 54*b* and 56*b* of leg portions 54 and 56 of the frame components. Cross frame plate 50 is then positioned against the outer sides of leg portions 54 and 56 and the frame and panel parts are fastened together by means of bolts 62 and nuts 64 together with a sheet metal door handle 84 which is associated with door frame member 46 and the bolt and nut components by which frame plate 50 and door panel 52 are fastened thereto. Door frame members 46 and 48 and door panel 52 are then further fastened together by means of a plurality of bolts 62 and nuts 64 spaced apart along the lengths of the frame members and mounting strip portions 76 and 78 of the door panel. Door frame member 48 provides the mounting side for the door assembly and, accordingly, a pair of hinges 86 are fastened to leg portion 60 thereof by means of corresponding nut and bolt assemblies. As will be appreciated from FIG. 5 and from the foregoing description of the door assembly, when the frame members and door panel are assembled the outer surfaces of top and bottom strips 68 and 70 of the door panel are coplanar with outer surfaces 54*a* and 56*a* of door frame members 46 and 48. Moreover, as described above, strips 68 and 70 are of a width corresponding to that of leg portions 54 and 56 of the frame members, whereby strip portions 68 and 70 simulate top and bottom cross frame members which together with leg portions 54 and 56 provides the appearance of a periperally continuous frame about central panel portion 66. Further, as will be appreciated from FIG. 5, second strip portions 72 and 74 of door panel 52 are coplanar with the top and bottom edges of door frame members 46 and 48 and extend between the inner surfaces of leg portions 58 and 60 thereof, thereby simulating top and bottom frame portions which, together with leg portions 58 and 60, provide the appearance of a peripherally continuous inwardly extending frame portion for the door assembly. Thus, a light weight door assembly in achieved which has sufficient structural integrity in connection with the mounting and use thereof as a result of the metal frame components 46, 48 and 50 and which, at the same time, has the appearance of a heavier door construction through the use of the non-metallic door panel 52 and the provision thereof with strip portions cooperable with frame components 46 and 48 to simulate a peripherally continuous metal frame construction.

It will be appreciated from FIG. 1 that locker unit 12 has two door assemblies 18 of the foregoing construction mounted thereon. As will be seen from FIG. 6, each door assembly 18 is mounted on the body portion of the locker unit by fastening hinges 86 to flange 34*c* of body portion frame member 34. Thus, it will be appreciated that each door is adapted to pivot outwardly and inwardly relative to body portion frame member 32 and that flange 32*d* thereof provides a stop or strike plate engaged by the inner side edge of leg portion 58 of door frame member 46 of each door to limit pivotal movement of the door in the closing direction.

In keeping with the intention to minimize the weight and cost of a locker unit, a small spring wire latch 88 is provided for retaining each door 18 in the closed position. In this respect, as will be appreciated from FIG. 7 of the drawing showing the latching arrangement for one door, flange 32*c* of body portion frame member 32 is provided with an opening 90 therethrough and a slot 92 spaced below opening 90. Spring wire latch 88 includes a leg portion 94 disposed behind flange 32*c* and having its upper end bent to form a loop 96. Latch 88 is attached to flange 32*c* by means of a bolt extending through opening 90 and loop 96 and a nut threaded onto the bolt, which bolt and nut are not designated numerically. The bottom end of leg portion 94 is provided with a generally V-shaped nose 98 which extends outwardly through slot 92 to an extent providing for the nose to be in the path of movement of leg portion 58 of door frame member 46 when the door is moved to the closed position. As will be seen in FIG. 6, leg portion 58 is provided with an opening 100 at a vertical location therealong corresponding to the position of nose 98, whereby the latter is adapted to project through opening 100 to hold door 18 in the closed position. As will be further appreciated from FIGS. 6 and 7, the inner edge of leg portion 58 of door frame member 46 will engage against leg portion 98*a* of latch nose 98 upon movement of the door towards the closed position, and that such engagement will deflect nose portion 98 laterally outwardly relative to flange 32*c* against the spring force biasing leg portion 94 toward the inner side of flange 32*c*. Upon continued closing movement of door 18, opening 100 therein moves into alignment with nose portion 98 whereby the biasing spring force projects nose 98 laterally outwardly into opening 100.

While the foregoing description of a locker unit in accordance with the present invention has been with reference to locker unit 12 illustrated in FIG. 1 and in which each door assembly 18 is of a vertical height corresponding one-half that of the open front of the body portion of the locker unit, it will be understood that the locker body portion described hereinabove can be provided with a full length door assembly such as door 16 illustrated in FIG. 1 in association with locker unit 10. In door assembly 16 the vertical heights of the frame members 46 and 48 are extended to correspond to the vertical height of the door opening and are laterally interconnected intermediate their opposite ends by cross frame plate 50. While a single plastic panel corresponding to panel 52 could be fastened to the frame members, it is preferred to attach two panels 52 thereto in that such enables providing a single panel construction for both a half and full height door. It will be appreciated of course that the door assembly 16 would be mounted on the body portion by corresponding hinges 86, would have a corresponding handle 84, and would be provided with a corresponding door latching arrangement as described hereinabove in connection with door assemblies 18.

FIGS. 8–10 illustrate another locker door construction in accordance with the present invention, and a unique hinge arrangement for mounting the door on the body portion of a locker. The door in this embodiment, represented by numeral 108 in FIG. 8, is of a width and height corresponding to door 18 described hereinabove, whereby it will be appreciated that two doors 108 would be mounted on a locker body portion such as that described above to close the open front thereof. Door 108 is a one-piece molded plastic member which, as will be appreciated from FIGS. 8 and 9, is comprised of coplanar top, center and bottom open mesh panel portions 110, 112 and 114, respectively, each of which is a planar simulation of expanded metal. Panel portion 110 is slightly recessed inwardly from a corresponding planar boundary portion including laterally opposite side portions 116 and 118 and top and bottom portions 120 and 122, respectively. Similarly, panel portion 112 is bounded by corresponding side portions 124 and 126 and top and bottom portions 128 and 130, respectively, and panel portion 114 is bounded by side portions 132 and 134 and top and bottom portions 136 and 138, respectively. Further, the laterally opposite front edges of door 108 are defined by ribs 140 and 142 extending the full height of the door, and laterally extending ribs 144, 146, 148 and 150 extend between ribs 140 and 142. The latter ribs are respectively adjacent top boundary portion 120 of panel 110, between boundry portions 122 and 128 of panels 110 and 112, between boundary portions 130 and 136 of panels 112 and 114, and adjacent boundary portion 138 of panel 114. The boundary portions of panels 110, 112, and 114 are coplanar and slightly recessed with respect to the coplanar outer surfaces of ribs 140–150. Ribs 144 and 150 are located inwardly from the corresponding one of the top and bottom ends of door 108, and the top and bottom ends include laterally extending recessed planar plate portions 152 and 154, respectively, which latter plate portions are coplanar with the boundary portions described above. Each of the plate portions 152 and 154 is provided with a corresponding pair of openings 156 therethrough, and the plate portions and openings serve the purpose set forth hereinafter.

Door 108 further includes rearwardly extending top, bottom and side flanges which are continuous about the periphery thereof and which include top and bottom flanges 158 and 160 extending rearwardly respectively from top and bottom plate portions 152 and 154. The side flange along the left hand side of door 108, which cannot be seen, extends between top and bottom flanges 158 and 160 and has a width corresponding to that of rib 140. The side flange extending along the right hand side of the door, designated by numeral 162 in FIG. 9 of the drawing, likewise extends between top and bottom flanges 158 and 160 and, with the exception of portions thereof to be described in detail hereinafter, has a width corresponding to rib 142.

As shown in FIGS. 8 and 9 of the drawing, the right hand side of door 108 is provided with three hinge pin components 164 molded integrally with the door and spaced apart along the side thereof. The right hand side further is provided with three hinge knuckle components 166 integrally molded with the door and separable therefrom in the manner and for the purpose set forth hereinafter. Each of the hinge pin components is of identical construction, as is each of the hinge knuckle components, whereby it will be apreciated that the following description of the ones shown in FIG. 9 is applicable to the others. With reference in particular to FIG. 9, hinge component 164 includes a body portion 168 molded integral with side flange 162 and a laterally inwardly offset portion **142*a* of rib 142, and a circular hinge pin 170 integral with and depending from the lower end of body portion 168. Offset portion 142*a* of rib 142 provides a laterally outwardly open recess 172 into which hinge pin 170 extends and which recess includes a bottom wall 174 spaced below bottom end 176 of hinge pin 170** a distance and for the purpose which will become apparent hereinafter.

Hinge knuckle component 166 includes a mounting portion 178 and a knuckle portion 180 provided with a circular bore 182 therethrough of a diameter to receive hinge pin 170. Hinge knuckle component 166 is integrally and removably connected to side flange 162 such as by means of a web of plastic 184 between the flange and mounting portion 178 and which web is adapted to be severed or fractured to achieve removal of the hinge knuckle component when the door is to be mounted in the manner described below. Hinge knuckle component 166 further includes axially opposite sides 186 and 188 with respect to the direction of bore 182 therethrough, and mounting portion 178 is provided with axially extending opposed recesses 190 between sides 186 and 188. Further, sides 186 and 188 are axially spaced apart a distance slightly less than the distance between bottom wall 174 of recess 172 and the lower end 176 of pin 170, whereby it will be appreciated that when the hinge knuckle component is removed from the door it is adapted to be positioned in recess 172 for bore 182 to be axially aligned with hinge pin 170.

With the foregoing description of door 108, hinge components 164 and hinge knuckle components 166 in mind, the mounting of the door on the body portion of a locker will be understood from the following description of FIG. 10 of the drawing. In connection with this embodiment of the invention, door 108 is mountable on a locker body portion such as the body portion described in connection with FIGS. 1–7, with the exception that door frame member 34 of the body portion is replaced by a door frame member designated by numeral 192 in FIG. 10. Door frame member 192 is of the same channel-shaped cross-sectional configuration and dimension as frame member 34 and, accordingly, includes an outer and rearwardly extending flange **192*a*, a web portion 192*b*, and a laterally inner and rearwardly extending flange 192*c*, which flanges and web correspond respectively with flanges 34*a* and 34*c* and web 34*b* of door frame member 34. Therefore, it will be appreciated that flange 192*c* provides a mounting flange for door 108 and, for this purpose, flange 192*c* is provided with a plurality of T-shaped slots 194 therethrough and spaced apart along the length thereof. While only a portion of door frame member 192 is shown in FIG. 10 it will be appreciated that the door frame member has a vertical height corresponding to that of member 34 of the body portion described hereinabove. Each of the T-slots 194 includes an upper portion 194*a* having a vertical height corresponding to the distance between sides 186 and 188 of hinge knuckle component 166 and a width enabling mounting portion 178 of the hinge knuckle component to be received therethrough. Further, each T-slot 194 includes a lower portion 194*b* which is narrower in width than upper portion 194*a*, thus providing opposed retaining edges 194*c* spaced apart a distance corresponding to the distance between the bottom walls of recesses 190 in the hinge knuckle component. Therefore, it will be appreciated that mounting portion 178 of the hinge knuckle component is adapted to be introduced through upper portion 194*a* of the T-slot and then moved downwardly for retaining portions 194*c* to be received in recesses 190 to hold the hinge knuckle component in place on door frame member 192. Thereafter, door 108 is positioned for knuckle portion 180 of the hingle knuckle component to be received in recess 172 beneath hinge pin 170 after which the door is lowered for hinge pin 170 to be received in bore 182 of the hinge knuckle component. While only one hinge knuckle component and corresponding hinge pin component of door 108 are shown in FIG. 10**, it will be appreciated that door frame member 192 would receive three hinge knuckle components in the T-slots positioned along flange 192*c* in accordance with the positions of the three hinge components on door 108 to achieve pivotal mounting of the door on the locker body.

In the manner described hereinabove in connection with doors 18, it will be appreciated that two individual doors 108 would be mounted on the body portion of a locker to provide upper and lower doors closing the open front of the body portion. At the same time, if it is desired to provide a body portion of a locker with a single door unit such as that illustrated in FIG. 1 of the drawing for the locker unit 10, two door panels 108 are adapted to be readily interconnected with one another to provide such a unitary door construction. In this respect, with reference again to FIG. 8, it will be appreciated that if two doors 108 are positioned in vertically adjacent relationship, the lower panel portion 154 of the upper door will be adjacent the upper panel portion 152 of the lower door. The recessed and coplanar relationship of panel portions 152 and 154 then enables a planar metal or plastic connecting plate, not illustrated, to be received in overlying relationship with respect to plate portions 152 and 154 and to be connected thereto by means of nut and bolt assemblies extending through openings 156 in plate portions 152 and 154 and corresponding openings in the connecting plate. Accordingly, the connecting plate then provides for the two doors to be interconnected for movement together between open and closed positions relative to the locker body portion. Additionally, the number of T-slots 194 in door frame member 192 and the spacing therebetween provides for the mounting of a unitary door on the body portion.

While not illustrated in FIGS. 8–10, it will be appreciated that individual doors 108 or a pair of doors interconnected to provide a unitary door as descibed above would be provided with openings appropriately located in the left hand side flange for cooperation with a latching member as illustrated and described in connection with FIG. 7 of the drawing, and that the door or doors would be provided with corresponding handles to facilitate the opening and closing thereof. For the latter purpose, as shown in FIG. 8, the left hand boundry portion 124 adjacent control panel 112 is provided with openings 196 to facilitate the mounting of a handle thereon through the use of nut and bolt assemblies. When two doors 108 are connected together as described above by means of a connecting plate, the left hand pair of openings 156 facilitate the mounting of a handle on the unitary door assembly.

With further reference to FIG. 1 of the drawing, the five door members 20 shown in connection with the locker unit 14 are light gauge sheet metal doors generally pan-shaped in cross-section, and it will be appreciated from the description of FIGS. 2–7 that the doors 20 can be mounted on the locker body frame component 34 through the use of hinges 86 and corresponding nut and bolt assemblies. Alternatively, doors 20 can be of pan-shaped one-piece molded plastic construction, and it will be appreciated from the description of FIGS. 8–10 that in the latter case each door 20 would include a pair of hinge pin components 164 and hinge knuckle components 166 molded integrally therewith at spaced apart locations along the right hand or mounting side of the door.

In the preferred embodiment, door frame member 192 preferably has ten T-slots 194 spaced apart along the length thereof. This advantageously enables the mounting of two individual doors 108, a unitary door defined by connecting two doors 108 together as described above, or five plastic doors 20 on a locker body portion, using a common door frame member 192. In this respect, the ten T-slots 194 are equally spaced apart from one another along the length of flange 192*c*, and the hinge pin components 164 on plastic doors 20 are spaced apart a distance corresponding to the spacing between adjacent ones of the T-slots, thus enabling the mounting of five doors 20 on the door frame member. At the same time, the hinge pin components 166 on door 108 are spaced apart from one another a distance corresponding to the spacing between alternate ones of the T-slots, and the upper and lower hinge pin components are respectively spaced from the upper and lower ends of the door a distance equal to one-half the spacing between adjacent T-slots. Accordingly, it will be appreciated that an upper door 108 would be hingedly mounted on the door frame member through the first, third and fifth T-slots, from the top member 192 toward the bottom thereof, and the lower door member 108 would be mounted on member 192 through the sixth, eighth and tenth T-slots.

While considerable emphasis has been placed on the preferred embodiments of the present invention herein illustrated and described, it will be appreciated that many embodiments of the invention can be made and that many changes can be made in the preferred embodiments without departing from the principles of the present invention. Accordingly, it is to be destinctly understood that the foregoing descriptive matter is to be interpreted merely as illustrative of the invention and not as a limitation.

Having thus described the invention, it is claimed:

1. A locker comprising a body portion having back wall means, side wall means, top wall means and bottom wall means, said side wall means and said top and bottom wall means extending forwardly from said back wall means and providing said body portion with an open front, frame means providing a door opening at said front having laterally spaced apart side edges, and a door hingedly connected along one of said side edges for closing said opening, said door comprising planar open mesh panel means of plastic material and means peripherally bounding said panel means, said means bounding said panel means including laterally spaced apart side portions having upper and lower ends and laterally extending top and bottom portions respectively between said upper and lower ends of said side portions, each said side portion extending along a different one of said side edges of said door opening, each of said side portions and each of said top and bottom portions including first plate means extending laterally inwardly of said door opening and said plate means extending axially inwardly of said door opening from the laterally outer edge of the corresponding one of said side, top and bottom portions, and at least said top and bottom portions being of plastic material formed integral with said open mesh panel means, said side portions of said means bounding said panel means comprising laterally spaced apart metal door frame members having first and second flanges respectively defining said first and second plate means of said side portions, metal cross member means laterally interconnecting said first flanges intermediate said upper and lower ends of said side portions, said first flange of each said door frame member having axially outer and inner sides with respect to said opening, said open mesh panel means being mounted on said inner sides of said first flanges, and said first plate means of said top and bottom portions of said means bounding said panel means having outer surfaces coplanar with said first flanges.

2. A locker according to claim 1, wherein said open mesh panel means simulates expanded metal.

3. A locker according to claim 1, wherein said open mesh panel means, door frame members and cross member means are interconnected by threaded fastener means.

4. A locker according to claim 1, wherein said cross member means is a planar sheet metal plate having side edges overlying said outer sides of said first flanges of said door frame members.

5. A locker according to claim 4, wherein said open mesh panel means simulates expanded metal.

6. A locker according to claim 5, wherein said open mesh means, door frame members and cross member means are interconnected by threaded fastener means.

7. A locker according to claim 1, wherein said side portions of said means bounding said open mesh panel means is of plastic material formed intergral with said panel means and said top and bottom portions.

8. A locker according to claim 7, wherein one of said side portions of said means bounding said panel means includes a plurality of hinge pin means of plastic material formed integrally therewith.

9. A locker according to claim 8, wherein said frame means providing said door opening includes a door mounting frame member providing one of said side edges of said opening, said one of said side portions having said hinge pin means thereon extending along said door mounting frame member, and a plurality of hinge knuckle means removably supported on said door mounting frame member to receive said hinge pin means to pivotally support said door on said body portion.

10. A locker according to claim 9, wherein said open mesh panel means simulates expanded metal.

11. A locker comprising a body portion having back wall means, side wall means, top wall means and bottom wall means, said side wall means and said top and bottom wall means extending forwardly from said back wall means and providing said body portion with an open front, frame means providing a door opening at said front having laterally spaced apart side edges, and a door hingedly connected along one of said side edges for closing said opening, said door comprising planar open mesh panel means of plastic material and means peripherally bounding said panel means, said means bounding said panel means including laterally spaced apart side portions having upper and lower ends and laterally extending top and bottom portions respectively between said upper and lower ends of said side portions, each of said side portion extending along a different one of said side edges of said door opening, each of said side portions and each of said top and bottom portions including first plate means extending laterally inwardly of said door opening and second plate means extending axially inwardly of said door opening from the laterally outer edge of the corresponding one of said side, top and bottom portions, and at least said top and bottom portions being of plastic material formed integral with said open mesh panel means, said side portions of said means bounding said panel means comprising laterally spaced apart metal door frame members having first and second flanges respectively defining said first and second plate means of said side portions, metal cross member means laterally interconnecting said first flanges intermediate said upper and lower ends of said side portions, said first flange of each said door frame member having axially outer and inner sides with respect to said opening, said open mesh panel means being mounted on said inner sides of said first flanges, and said first plate means of said top and bottom portions of said means bounding said panel means having outer surfaces coplanar with said first flanges, said cross member means being a planar sheet metal plate having side edges overlying said outer sides of said first flanges of said door frame members, said frame means providing said door opening including leg means extending downwardly below said bottom wall means, and said back wall means extending downwardly below said bottom wall means and having a lower edge extending laterally between said side wall means, whereby said body portion is adapted to be supported on an underlying surface by said leg means and said lower edge of said back wall means.

12. A locker comprising a body portion having back wall means, side wall means, top walls means and bottom wall means, said side wall means and said top and bottom wall means extending forwardly from said back wall means and providing said body portion with an open front, frame means providing a door opening at said front having laterally spaced apart side edges, and a door hingedly connencted along one of said side edges for closing said opening, said door comprising planar open mesh panel means of plastic material and means peripherally bounding said panel means, said means bounding said panel means including laterally spaced apart side portions having upper and lower ends and laterally extending top and bottom portions respectively between said upper and lower ends of said side portions, each said side portion extending along a different one of said side edges of said door opening, each of said side portions and each of said top and bottom portions including first plate means extending laterally inwardly of said door opening and second plate means extending axially inwardly of said dooı opening from the laterally outer edge of the corresponding one of said side, top and bottom portions, and at least said top and bottom portions being of plastic material formed intergral with said open mesh panel means, said side portions of said means bounding said open mesh panel means being of plastic material formed integral with said panel means and said top and bottom portions, one of said side portions of said means bounding said panel means including a plurality of hinge pins means of plastic material formed integrally therewith, said frame means providing said door opening including a door mounting frame member providing one of said side edges of said opening, said one of said side portions having said hinge pin means thereon extending along said door mounting frame member, and a plurality of hinge knuckle means removably supported on said door mounting frame member to receive said hinge pin means to privotally support said door on said body portion, said door mounting frame member including a plurality of T-slots, and each said hinge knuckle means including a mounting portion contoured to be inserted through one portion of a corresponding T-slot and displaced into another portion of the slot for interengagement with said door mounting frame member against displacement axially of said corresponding T-slot.

13. A locker comprising a body portion having back wall means, side wall means, top wall means and bottom wall means, said side wall means and said top and bottom wall means extending forwardly from said back wall means and providing said body portion with an open front, frame means providing a door opening at said front having laterally spaced apart side edges, and a door hingedly connected along one of said side edges for closing said opening, said door comprising planar open mesh panel means of plastic material and means peripherally bounding said panel means, said means bounding said panel means including laterally spaced apart side portions having upper and lower ends and laterally extending top and bottom portions respectively between said upper and lower ends of said side portions, each said side portion extending along a different one of said side edges of said door opening, each of said side portions and each of said top and bottom portions including first plate means extending laterally inwardly of said door opening and said plate means extending axially inwardly of said door opening from the laterally outer edge of the corresponding one of said side, top and bottom portions, and at least said top and bottom portions being of plastic material formed integral with said open mesh panel means, said side portions of said means bounding said open mesh panel means being of plastic material formed integral with said panel means and said top and bottom portions, one of said side portions of said means bounding said panel means including a plurality of hinge pin means of plastic material formed integrally therewith, said frame means providing said door opening including a door mounting frame member providing one of said side edges of said opening, said one of said side portions having said hinge pin means thereon extending along said door mounting frame member, and a plurality of hinge knuckle means removably supported on said door mounting frame member to receive said hinge pin means to pivotally support said door on said body portion, said frame means providing said door opening including leg means extending downwardly below said bottom wall means, and said back wall means extending downwardly below said bottom wall means and having a lower edge extending laterally between said side wall means, whereby said body portion is adapted to be supported on an underlying surface by said leg means and said lower edge of said back wall means.

14. A locker comprising a body portion and a door each assembled from preformed component parts interconnected by separable fastener means, said component parts of said body portion including back, side, top and bottom wall panels of sheet metal, said side wall panels and said top and bottom wall panels extending forwardly from said back wall panel and having forward ends providing said body portion with an open front, said component parts of said body portion further including upright metal side frame members along the forward ends of said side wall panels and metal top and bottom frame members between said side frame members and respectively along the forward ends of said top and bottom wall panels, said side, top and bottom frame members providing a door opening at said open front, said component parts of said door including a pair of laterally spaced apart upright L-shaped metal frame members having opposite ends, and a sheet metal cross member between said L-shaped frame members and intermediate said opposite ends thereof, said L-shaped frame members each having first and second leg portions between said opposite ends, said first leg portions being coplanar and having axially outer and inner sides with respect to said door opening and said second leg portions extending axially inwardly from said first leg portions with respect to said door opening, said cross member having opposite ends overlying said outer sides of said first leg portions, said component parts of said door further including a plastic door panel having upright side portions, laterally extending top and bottom portions and an open mesh central panel portion therebetween, said side portions of said door panel overlying said inner sides of said first leg portions of said L-shaped frame members between said opposite ends thereof, said top and bottom portions of said door panel each including a first strip portion between and coplanar with said first leg portions of said L-shaped frame members at the corresponding ends thereof and a second strip portion extending axially inwardly from said first strip portion and laterally between said second leg portions of said L-shaped frame members at said corresponding ends thereof, and hinge means between said second leg portion of one of said L-shaped frame members and one of said side frame members of said body portion pivotally supporting said door on said body portion, said open mesh central panel portion simulating planar expanding metal, and said back wall panel and said side frame members of said body portion extending below said bottom wall panel to support said body portion above an underlying support surface.

15. A locker according to claim 14, wherein the other of said side frame members and said second leg portion of the other of said L-shaped frame members are provided with interengaging latch means to releaseably hold said door in the closed position thereof.

16. A locker according to claim 15, wherein said other of said side frame members includes stop means to limit movement of said door in the direction of closing, and said latch means includes spring wire latch member means supported on said other side frame member and an opening in said second leg portion of said other L-shaped frame member cooperable with said latch member means.

17. A locker comprising a body portion having back wall means, side wall means, top wall means and bottom wall means, said side wall means and said top and bottom wall means extending forwardly from said back wall means and providing said body portion with an open front, frame means providing a door opening at said front having laterally spaced apart side edges, and a door hingedly connected along one of said side edges for closing said opening, said door being of one-piece construction from plastic material and including panel means and means peripherally bounding said panel means, said means bounding said panel means including laterally spaced apart side portions extending axially inwardly of said door opening and having upper and lower ends and top and bottom portions respectively between said upper and lower ends of said side portions and extending axially inwardly of said door opening, each said side portion extending along a different one of said side edges of said door opening, one of said side portions of said means bounding said panel means including a plurality of hinge pin means of plastic material formed integrally therewith, said frame means providing said door opening including a door mounting frame member provding one of said side edges of said opening, the one of said side portions having said hinge pin means thereon extending along said door mounting frame member, and a plurality of hinge knuckle means removably supported on said door mounting frame member to receive said hinge pin means to pivotally support said door on said body portion, said door mounting frame member including a plurality of T-slots, and each said hinge knuckle means including a mounting portion contoured to be inserted through one portion of a corresponding T-slot and displaced into another portion of the slot for interengagement with said door mounting frame member against displacement axially of said corresponding T-slot.

18. A locker according to claim 17, wherein said panel means of said door includes planar open mesh panel portions.

19. A locker according to claim 17, wherein each said hinge pin means includes a body portion integral with said one of said side portions and a hinge pin depending from said body portion, said one side portion including wall means providing a laterally outwardly open recess below said body portion, said hinge pin extending into said recess and having a lower end, said wall means including a bottom wall spaced below said lower end of said hinge pin, said hinge knuckle means including a knuckle portion received in said recess in the space between said lower end of said pin and said bottom wall, and said knuckle portion having a bore therethrough for receiving said pin when said knuckle portion is received in said space and displaced upwardly in said recess relative to said pin.

20. A locker according to claim 19, wherein said panel means of said door includes planar open mesh panel portions.

21. A locker comprising a body portion having back wall means, side wall means, top wall means and bottom wall means, said side wall means and said top and bottom wall means extending forwardly from said back wall means and providing said body portion with an open front, frame means providing a door opening at said front having laterally spaced apart side edges, and a door hingedly connected along one of said side edges for closing said opening, said door being of one-piece construction from plastic material and including panel means and means peripherally bounding said panel means, said means bounding said panel means including laterally spaced apart side portions extending axially inwardly of said door opening and having upper and lower ends and top and bottom portions respectively between said upper and lower ends of said side portions and extending axially inwardly of said door opening, each said side portion extending along a different one of said side edges of said door opening, one of said side portions of said means bounding said panel means including a plurality of hinge pin means of plastic material formed integrally therewith, said frame means providing said door opening including a door mounting frame member provding one of said side edges of said opening, the one of said side portions having said hinge pin means thereon extending along said door mounting frame member, and a plurality of hinge knuckle means removably supported on said door mounting frame member to receive said hinge pin means to pivotally support said door on said body portion, each said hinge pin means including a body portion integral with said one of said side portions and a hinge pin depending from said body portion, said one side portion including wall means providing a laterally outwardly open recess below said body portion, said hinge pin extending into said recess and having a lower end, said wall means including a bottom wall spaced below said lower end of said hinge pin, said hinge knuckle means including a knuckle portion received in said recess in the space between said lower end of said pin and said bottom wall, and said knuckle portion having a bore therethrough for receiving said pin when said knuckle portion is received in said space and displaced upwardly in said recess relative to said pin, said door mounting frame member including a plurality of T-slots each having an upper portion and a lower portion, said lower portion opening into said upper portion and being narrower than said upper portion, and each said hinge knuckle means further including a mounting portion integral with said knuckle portion, said mounting portion and said T-slot being cooperatively contoured for said mounting portion to be received through said upper portion of said slot and displaced into said lower portion for interengagement with said door mounting frame member against displacement axially of said T-slot.

22. A locker according to claim 21, wherein said mounting frame member has upper and lower ends and includes ten T-slots equally spaced apart from one another between said ends.

23. A locker according to claim 22, wherein said plurality of hinge pin means on said door includes two hinge pin means spaced apart a distance corresponding to the spacing between said T-slots.

24. A locker according to claim 22, wherein said plurality of hinge pin means on said door includes three hinge pin means spaced apart from one another a distance corresponding to the spacing between alternate ones of said T-slots.

25. A locker according to claim 21, wherein said hinge knuckle means is initially integrally molded with said one side portion and integrally connected thereto by web means severable for removal of said hinge knuckle means from said door.

* * * * *